US006152676A

United States Patent [19]

Evert et al.

[11] Patent Number: 6,152,676

[45] Date of Patent: Nov. 28, 2000

[54] MULTI-FUNCTION LEVER FOR AN INDUSTRIAL TRUCK

[75] Inventors: Rainer Evert, Rausdorf; Georg Fromme, Seevental; Jens-Peter Petersen, Hamburg, all of Germany

[73] Assignee: Still GmbH, Germany

[21] Appl. No.: 09/287,527

[22] Filed: Apr. 7, 1999

[30] Foreign Application Priority Data

Apr. 15, 1998 [DE] Germany ..... 198 16 682

[51] Int. Cl.[7] ..... G05G 9/04

[52] U.S. Cl. ..... 414/631; 414/635; 187/224; 180/333; 74/471 XY

[58] Field of Search ..... 187/224; 180/333; 74/523, 471 XY; 414/631, 635

[56] References Cited

U.S. PATENT DOCUMENTS

| | | | |
|---|---|---|---|
| 3,811,336 | 5/1974 | Pulskanp | 74/471 XY |
| 3,937,294 | 2/1976 | Haddock | 180/77 R |
| 4,012,014 | 3/1977 | Marshall | 74/523 X |
| 4,491,325 | 1/1985 | Bersheim | 74/523 X |
| 4,742,468 | 5/1988 | Ohashi et al. | 364/424 |
| 5,042,314 | 8/1991 | Rytter | 180/333 X |
| 5,116,180 | 5/1992 | Fung et al. | 74/523 X |
| 5,197,347 | 3/1993 | Moffitt et al. | 74/523 X |
| 5,473,235 | 12/1995 | Lance et al. | 74/471 XY |

FOREIGN PATENT DOCUMENTS

| | | | |
|---|---|---|---|
| 1246429 | 8/1967 | Germany . | |
| 2533380 | 7/1975 | Germany . | |
| 7822523 | 7/1978 | Germany . | |
| 9417838 | 11/1994 | Germany . | |
| 899800 | 4/1996 | Japan | 187/224 |

*Primary Examiner*—Steven A. Bratlie

*Attorney, Agent, or Firm*—Webb Ziesenheim Lodgson Orkin & Hanson, P.C.

[57] ABSTRACT

A multi-function lever for an industrial truck has a lever that can be pivoted around at least a first axis and at least one control element located on the lever. By pivoting the lever around the first axis and by actuating the control element, it is possible to actuate at least one function each of the industrial truck. The invention teaches that the control element can be actuated by pivoting around a second axis, wherein the second axis is substantially parallel to the first axis. The control element can be actuated with the index finger of a hand gripping the hand grip. By pivoting the lever, a vertical movement of the load holding device can be controlled, and by pivoting the control element, a tilting of the load holding device can be controlled.

17 Claims, 1 Drawing Sheet

MULTI-FUNCTION LEVER FOR AN INDUSTRIAL TRUCK

BACKGROUND OF THE INVENTION

1. Field of the Invention

This invention relates generally to a multi-function lever for an industrial truck that can be rotated around a first axis, with at least one control element located on the lever. At least one function of the industrial truck can be controlled by rotating the lever around the first axis and/or by actuating the control element.

2. Description of the Currently Available Technology

Multi-function levers of the type described above are generally used in industrial trucks to control a variety of functions of a load holding device. For example, the load holding device can be moved up and down in a vertical direction or the load holding device can be tilted around a horizontal axis. In similar systems of the prior art, the load holding device can also be moved horizontally in one or two directions.

Multi-function levers are used to make it possible for an operator to sequentially or simultaneously actuate different functions of the industrial truck without having to move his hands back and forth between different levers of the conventional type. Using a single multi-function lever, it becomes possible for the operator to control at least two functions of the industrial truck.

To minimize the danger of incorrect or accidental operation of the industrial truck, designers attempt to locate the required actuation device of the lever or of the control element as functionally logically as possible with respect to the function to be controlled. An additional objective in the configuration of multi-function levers is to make possible a sequential or simultaneous actuation of different functions in an ergonomically advantageous manner. Multi-function levers of the prior art are unable to satisfactorily meet all of the requirements described above.

Therefore, it is an object of this invention to provide a multi-function lever for an industrial truck on which the most important functions can be controlled logically and in an ergonomically advantageous manner.

SUMMARY OF THE INVENTION

The invention teaches that a control element located on the lever can be actuated by rotating the control element around a second axis, wherein the second axis is substantially parallel to the first axis around which the lever may rotate. As a result of this arrangement of the control element, the multi-function lever can be used to control two functions which logically should be actuated in the same direction. The two axes are therefore preferably substantially parallel to one another, particularly in the idle position of the multi-function lever. When a third function is actuated, however, it can sometimes occur that the two axes are inclined toward one another, so that they are no longer exactly parallel. The functionally logical layout of the actuation devices for the two functions to be controlled is nevertheless retained.

It is particularly advantageous if the control element can be actuated with the index finger of a hand gripping a handle portion of the lever. The control element can be actuated with great sensitivity and precision with the index finger, which means that the control element can also be used to generate multi-step or continuously variable control signals.

An ergonomically favorable arrangement results if the control element is located on the side of the lever that faces away from the operator, e.g., toward the front of the vehicle. With this arrangement, the operator can grip the lever with the hand, whereupon the index finger is automatically in the vicinity of the control element in the natural position of the hand.

If the industrial truck has a load holding device that can be moved in a vertical direction, the vertical movement of the load holding device can be preferably controlled by pivoting the lever around the first axis. The raising and lowering of the load holding device can thus be controlled by the operator by a movement of the entire hand.

A functionally logical layout of the movement functions of the lever and load holding device, and one which corresponds to current conventions, can be achieved if a pivoting of the lever toward the load holding device is associated with a vertically descending movement of the load holding device and a pivoting of the lever away from the load holding device is associated with a vertically ascending movement of the load holding device.

If the industrial truck has a load holding device that can be pivoted or tilted around a substantially horizontal axis of inclination, it is appropriate if the inclination of the load holding device can be controlled by pivoting the control element around the second axis. The tilting of the load holding device can thus be controlled by the operator using the index finger of the hand gripping the grip.

This arrangement is particularly appropriate if the second axis is oriented substantially parallel to the horizontal axis of inclination, and a pivoting movement of the control element is associated with a tilting movement of the load holding device in the corresponding direction.

It is also possible that a third function of the industrial truck can be controlled by pivoting the lever around a third axis, whereby the third axis is oriented substantially perpendicular to the first axis. To control the third function, the operator can move or pivot the lever to the left or right, from his perspective. In particular if the industrial truck has a load holding device that can be displaced in a transverse direction of the industrial truck, it is appropriate if the displacement of the load holding device can be controlled by pivoting the lever around the third axis.

In an advantageous configuration of the invention, when the control element is actuated, a defined speed of inclination of the load holding device can be specified as a function of the rotational angle of the control element. For this purpose, there is a neutral position for the control element, and the control element has means to generate a restoring force toward the neutral position, i.e., a biasing spring or similar device. If the operator is not actuating the control element, the control element is guaranteed to be in the neutral position, and therefore no tilting movement of the load holding device occurs.

In another configuration of the invention, when the control element is actuated, a defined setpoint can be specified for the inclination of the load holding device as a function of the angle of rotation of the control lever. Means are also provided to measure the actual inclination of the load holding device. There is also an actuator, for example a hydraulic cylinder, to generate a tilting movement of the load holding means, which is controlled in a feedback control system as a function of the inclination setpoint and the actual inclination. In this arrangement, the operator uses the control element to specify the setpoint for the inclination. In a feedback control system, the actuator element is actuated until the actual inclination equals the specified value. In this configuration, it is appropriate if the control element does not have any means to generate a restoring force. If the operator does not change the position of the control element, the control element remains in its set position so that the setpoint for the inclination also remains unchanged.

Additional functions can be controlled with the multi-function lever if there is at least one switch element located on the lever. When this switch element or these switch elements are actuated by means of the control element, instead of the tilting of the load holding device, an additional function of the industrial truck can be controlled. The additional functions, for example a load gripper device or a pusher device, can be defined as a function of the specific realization of the industrial truck.

The switching element is appropriately active only when the control element is in a neutral position. This measure guarantees that the actuation of the switching element cannot result in an erroneous or unintentional operation of the functions controlled with the control element.

BRIEF DESCRIPTION OF THE DRAWINGS

Additional advantages and details of the invention are explained in greater detail on the basis of the exemplary embodiment illustrated in the accompanying schematic drawings, in which.

DESCRIPTION OF THE PREFERRED EMBODIMENTS

Figure 1:
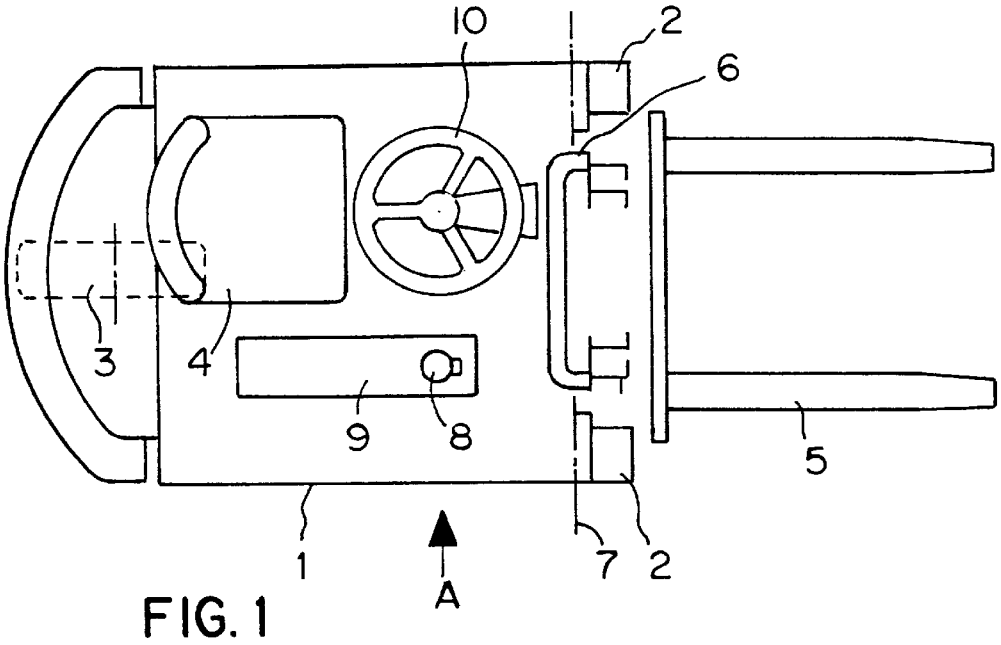
FIG. 1 is a plan view of an industrial truck having a multi-function lever of the invention.

For purposes of the description hereinafter, directional terms such as "left", "right", "vertical", "horizontal", etc., shall relate to the invention as it is shown in the drawings. However, it is to be understood that the invention may assume various alternative orientations.

The industrial truck of the invention shown in FIG. 1 has a vehicle frame 1 which runs on a road, floor or other surface by means of two drive wheels 2 on the load side and one rear steerable wheel 3. On the vehicle frame 1 are a driver's seat 4 and a steering wheel 10, arranged so that an operator seated in the driver's seat has a view of a load holding device 5.

In this embodiment, the load holding device 5 is realized in the form of a fork lift. However, the load holding device 5 could be any conventional holding device. The load holding device 5 is fastened to the vehicle frame 1 by means of a hoisting platform 6 so that the holding device 5 can be moved up and down. Together with the hoisting platform 6, the load holding device 5 can be pivoted or tilted relative to the vehicle frame 1 around a substantially horizontal axis 7. Alternatively, the hoisting platform may be fastened rigidly to the vehicle frame and the load holding device can be tilted relative to the hoisting platform. A side loader can also be provided, by means of which the load holding device 5 can be displaced relative to the hoisting platform 6 in a lateral or transverse direction of the industrial truck, i.e., pivoted or displaced toward the axis 7.

The functions of the load holding device 5 described above can be controlled with a multi-function lever 8 of the invention. The multi-function lever is located on the forward end of an armrest 9 located next to the driver's seat 4 so that it can be actuated by the operator using his right hand.

Figure 2:
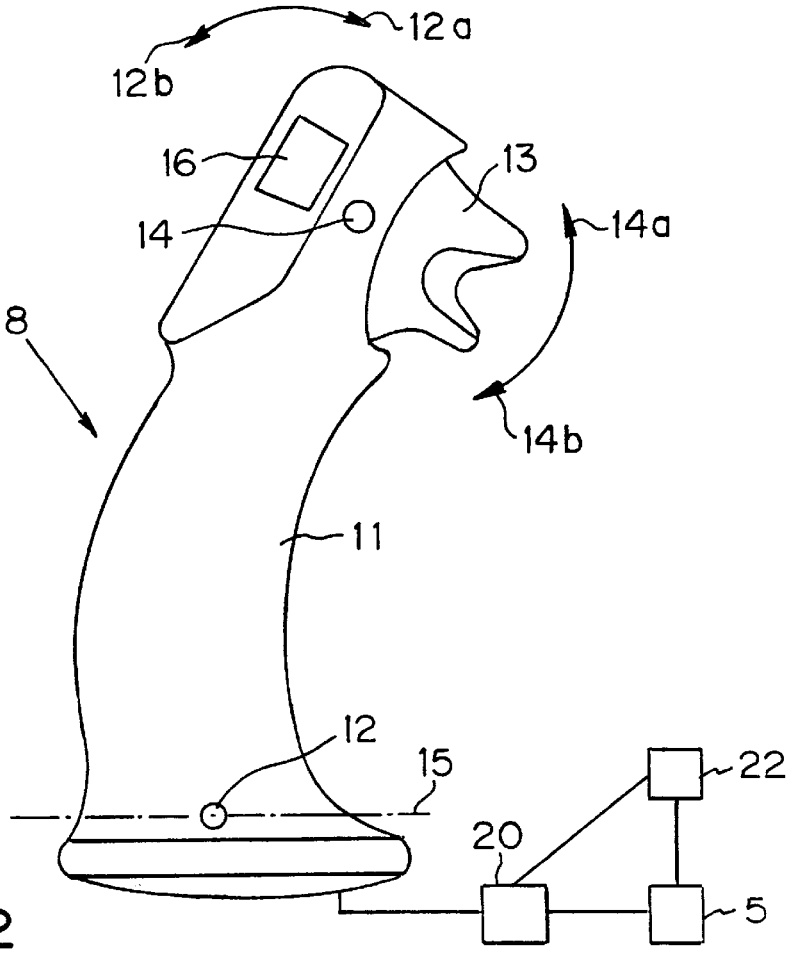
FIG. 2 is a side, schematic view of a multi-function lever of the invention.

FIG. 2 shows the multi-function lever 8 as viewed from direction A in FIG. 1. The multi-function lever 8 has, as its base body, a lever 11 movably fastened to the armrest 9. The lever 11 can be pivoted around a first axis 12 that extends substantially in the transverse or lateral direction of the industrial truck, and can be used, for example, to control the vertical movement of the load holding device 5. For example, when the lever 11 is pivoted forward in direction 12*a* around the first axis 12, the load holding device 5 moves downwardly until the lever 11 is actuated in direction 12*b* or the load holding device 5 reaches its lowermost position.

The invention teaches that located on the lever 11 is a movable control element 13 that can be pivoted around a second axis 14. At least in an idle position of the lever 11, the axes 12 and 14 are substantially parallel to one another. Using the control element 8, the inclination of the load holding device 5 around the substantially horizontal axis 7 can be controlled. The axes 7 and 14 are also preferably substantially parallel to one another. Actuation of the control element 13 in direction 14*a* or 14*b*, as a result of a functionally logical association, results in an inclination of the load holding device 5 in the same direction of rotation, i.e., movement of the control element 13 in direction 14*b* pivots the loading holding device 5 downwardly and movement in direction 14*a* pivots the loading holding device 5 upwardly.

The lever 11 can also be pivoted around a substantially horizontal third axis 15 that extends substantially in a longitudinal direction of the industrial truck. By pivoting the lever 11 around the axis 15, an additional component, such as a side loader (not shown) can be controlled in a functionally logical association with the actuation device.

Also located on the lever 11 is an additional switching element 16 that can be actuated with, e.g., simultaneously with, the control element 13. When the switching element 16 is actuated, a function of the industrial truck other than the tilting of the load holding device 5 is associated with the control element 13. Such other functions can include the operation of accessory devices, such as a pusher for the load or a gripping device, just to name a few.

The lever 8 is preferably operationally connected, e.g., electronically, to a control system 20 for the industrial truck. The control system 20 is connected to the load holding device 5 and also to an inclination measurement device 22 which measures the actual inclination of the load holding device 5. An actuator element may be connected to the load holding device 5 to generate a tilting movement of the load holding device 5. The actuator is controlled in a feedback control system as a function of an inclination setpoint and the actual inclination of the holding device.

While the invention is described in detail herein, it will be appreciated by those skilled in the art that various modifications and alternatives to the arrangements can be developed in light of the overall teachings of the disclosure. Accordingly, the particular arrangements described above are illustrative only and are not limiting as to the scope of the invention, which is to be given the full breadth of the appended claims and any and all equivalents thereof.

What is claimed is:

1. A multi-function lever for an industrial truck having a load holding device movable in a substantially vertical direction, comprising:

a lever pivotable around at least a first axis, wherein substantially vertical movement of the load holding device is controlled by pivoting the lever around the first axis; and at least one control element located on the lever, wherein the control element is pivotable around a second axis and is actuated by being pivoted around the second axis, wherein the second axis is substantially parallel to the first axis, and wherein the load holding device is also movable around a substantially horizontal axis of inclination and an inclination of the load holding device is controlled by pivoting the control element around the second axis.

2. The multi-function lever as claimed in claim 1, wherein the control element is configured to be actuated by an index finger of a hand gripping the hand grip.

3. The multi-function lever as claimed in claim 1, wherein the control element is located on a side of the lever facing away from a driver's seat.

4. The multi-function lever as claimed in claim 1, wherein pivoting the lever toward the load holding device moves the load holding device vertically downwardly and pivoting the lever away from the load holding device moves the load holding device vertically upwardly.

5. The multi-function lever as claimed in claim 1, wherein the second axis is oriented substantially parallel to the substantially horizontal axis of inclination and a pivoting movement of the control element pivots the load holding device in a corresponding direction.

6. The multi-function lever as claimed in claim 5, wherein a third function of the industrial truck is controlled by pivoting the lever around a third axis, wherein the third axis is oriented substantially perpendicular to the first axis.

7. The multi-function lever as claimed in claim 6, wherein the industrial truck has a load holding device displaceable in the transverse direction of the industrial truck, and the displacement of the load holding device is controlled by pivoting the lever around the third axis.

8. The multi-function lever as claimed in claim 1, wherein when the control element is actuated, a defined speed of inclination of the load holding device is specified as a function of an angle of rotation of the control element.

9. The multi-function lever as claimed in claim 8, wherein the control element has a neutral position and the control element has means to generate a restoring force toward the neutral position.

10. The multi-function lever as claimed in claim 1, wherein when the control element is actuated, a defined setpoint for the inclination of the load holding device is specified as a function of an angle of rotation of the control element.

11. The multi-function lever as claimed in claim 10, including means for measuring the actual inclination of the load holding device.

12. The multi-function lever as claimed in claim 10, including an actuator element in a feedback control system to generate a tilting movement of the load holding device, wherein the actuator element is controlled as a function of the setpoint for the inclination and the actual inclination.

13. The multi-function lever as claimed in claim 10, wherein the control element does not have means to generate a restoring force.

14. The multi-function lever as claimed in claim 1, including at least one switching element located on the lever and which switching element, when actuated by the control element, controls a function of the industrial truck other than tilting of the load holding device.

15. The multi-function lever as claimed in claim 14, wherein the switching element is effectively actuated only when the control element is in a neutral position.

16. A multi-function lever for an industrial truck having a load holding device movable in a substantially vertical and a transverse direction, comprising:

a lever pivotable around a first axis and a third axis, wherein substantially vertical movement of the load holding device is controlled by pivoting the lever around the first axis and transverse movement of the load holding device is controlled by pivoting the lever around the third axis; and at least one control element located on the lever and pivotable around a second axis, wherein the load holding device is also movable around an axis of inclination and inclination of the load holding device is controlled by pivoting the control element around the second axis, wherein the second axis is substantially parallel to the first axis and the third axis is substantially perpendicular to the first axis.

17. The multi-function lever as claimed in claim 16, at least one switching element located on the lever to control a function of the industrial truck, wherein the switching element is effectively actuated only when the control element is in a neutral position.

* * * * *